United States Patent [19]

Braun

[11] 4,250,682

[45] Feb. 17, 1981

[54] WHEEL ASSEMBLY FOR USE IN AN APPARATUS FOR MULTIPACKAGING CONTAINERS

[75] Inventor: Leonard C. Braun, Bartlett, Ill.

[73] Assignee: Illinois Tool Works Inc., Chicago, Ill.

[21] Appl. No.: 59,019

[22] Filed: Jul. 19, 1979

[51] Int. Cl.[3] ..... B65B 27/04; B65B 21/00

[52] U.S. Cl. ..... 53/48; 53/556

[58] Field of Search ..... 53/48, 556, 582, 398

[56] References Cited

U.S. PATENT DOCUMENTS

| | | | |
|---|---|---|---|
| 3,032,943 | 5/1962 | Reimers et al. | 53/48 |
| 3,032,944 | 5/1962 | Hull et al. | 53/48 |
| 3,221,470 | 12/1965 | Stevenson, Jr. | 53/48 |
| 3,383,828 | 5/1968 | Cunningham | 53/48 X |
| 3,742,677 | 7/1973 | Best | 53/48 X |
| 3,775,935 | 12/1973 | Schlueter et al. | 53/48 |
| 3,816,968 | 6/1974 | Morgan et al. | 53/48 |
| 3,959,949 | 6/1976 | Benno et al. | 53/48 X |
| 4,079,571 | 3/1978 | Schlueter et al. | 53/48 |

*Primary Examiner*—Horace M. Culver
*Attorney, Agent, or Firm*—Thomas W. Buckman

[57] ABSTRACT

An improvement in an apparatus for applying packaging devices to containers where a continuous strip of resilient plastic carrier devices are stretched and applied to containers for producing packages. A series of pairs of stretching members, one of which is fixed, and the other of which is reciprocating, creates an efficient applicating system while minimizing the cost and maintenance of such a machine.

6 Claims, 7 Drawing Figures

Fig.4
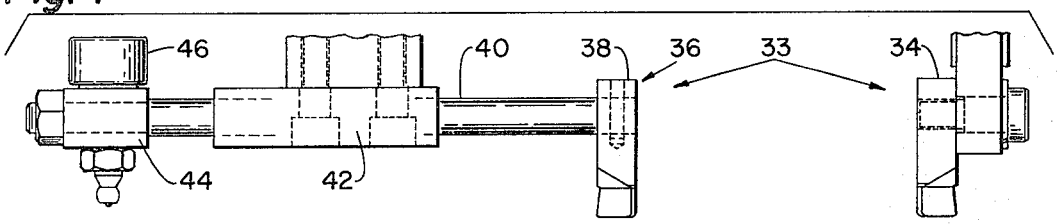
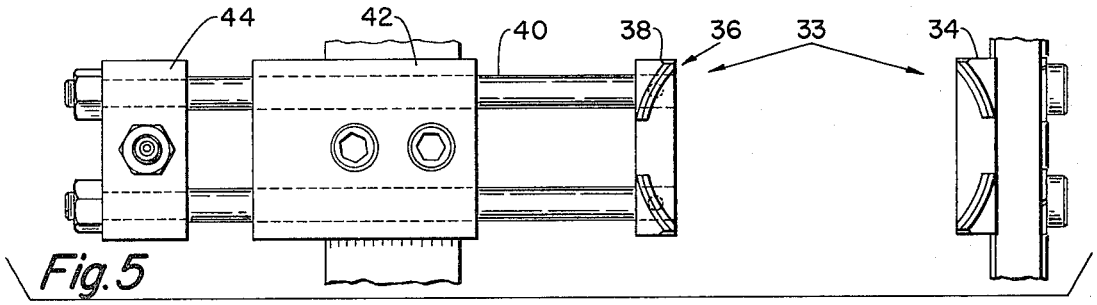
Fig.5
Fig.6
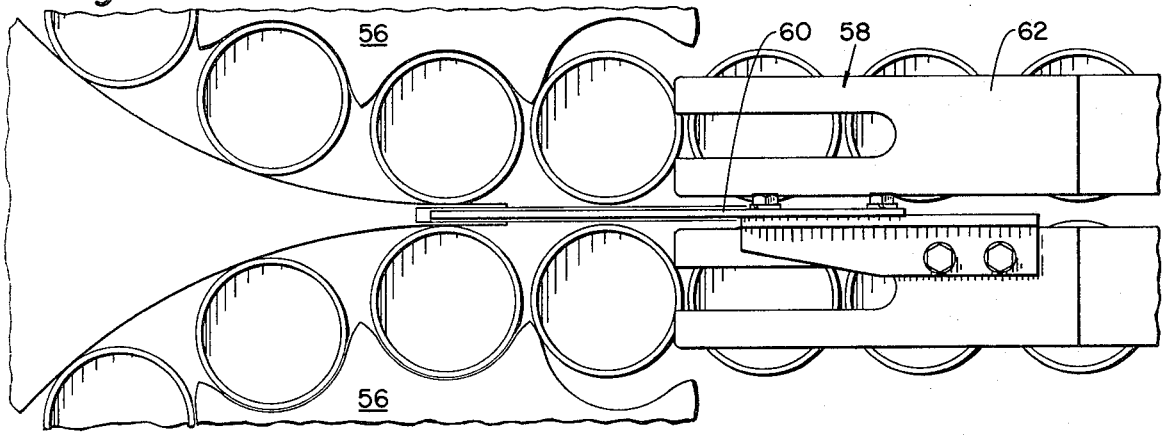
Fig.7
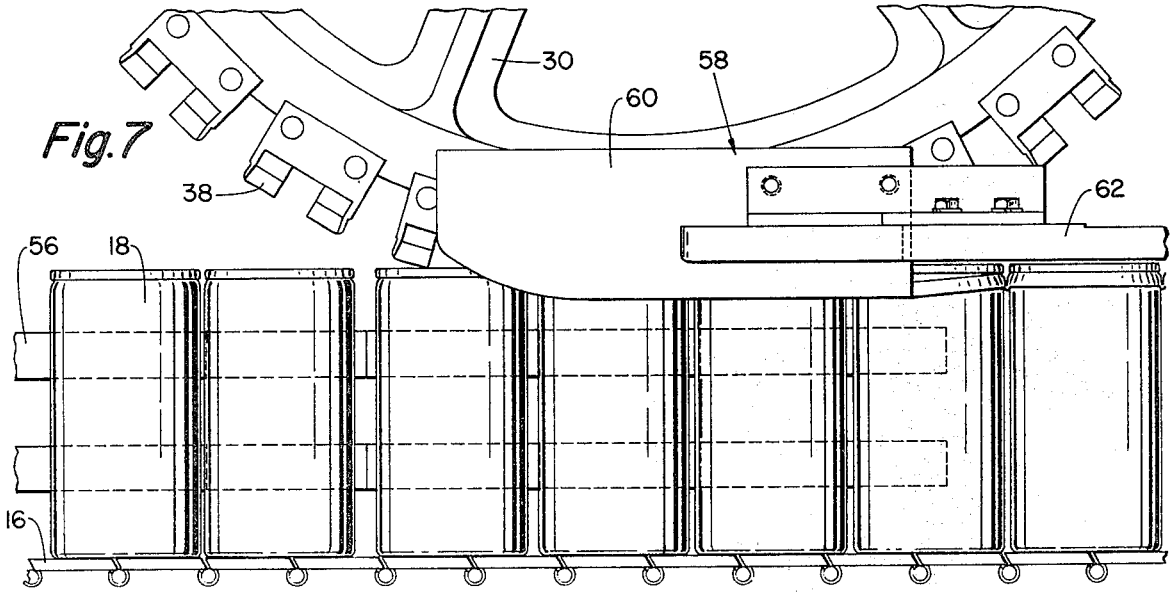

WHEEL ASSEMBLY FOR USE IN AN APPARATUS FOR MULTIPACKAGING CONTAINERS

BACKGROUND OF THE INVENTION

Drum assemblies which form a part of a carrier applicating machine are shown in U.S. Pat. Nos. 3,032,943 and 3,032,944. Such assemblies utilize jaw stations which incorporate pairs of moving jaws, with one pair to be associated with each aperture in the carrier. The jaw members of each pair are moved apart from each other as the drum rotates thereby stretching the apertures to snap over the chimes of containers. Cam followers are associated with each jaw and rotate about an axis in fixed cam tracks on either side of the work station which the containers are passed through. Certain improvements to this basic machine are also shown in U.S. Pat. No. 3,816,968. This patent also shows the use of a pair of jaws to reconfigure and stretch each aperture and also uses the technique of controlling the movement of the jaws by cams on both sides of the work station. The improvement in this device is the differential movement between the innermost jaws and the outermost jaws in the jaw stations which include four moving jaws.

Other devices, such as that shown in U.S. Pat. No. 3,959,949, eliminate the necessity of a pair of jaws for each aperture but continue to utilize cam and cam followers on both sides of the drum to control linear movement of each jaw member in each set of jaws.

SUMMARY OF THE INVENTION

In the subject invention, a series of jaw stations are arranged about a rotating spider wheel assembly with each jaw station including a single pair of opposing jaw members transversely aligned and mounted about the periphery of a pair of parallel spaced spider wheels mounted on a common rotatable shaft. One of each pair of stretching or jaw members is fixed to the periphery of one of the spider wheels and becomes essentially a static stretching member. The opposing stretching or jaw member is mounted for slidable or reciprocating movement to and from its associated opposite fixed member with the movement controlled by a cam follower in cooperation with a cam track. This configuration is in contradistinction to the drum-type assemblies of the prior art which provide a plurality of integral jaw stations essentially creating struts between spaced spider wheels. The prior art further requires lateral reciprocating movement of each jaw member in each jaw station.

In the present invention, the single moveable jaw in each station essentially creates a dynamic stretching member which cooperates with the single static stretching member or jaw on the opposite side of the wheel assembly.

A carrier, particularly designed to be stretched utilizing only a single pair of opposing jaws, is fed onto the wheel assembly in a manner typical of the prior art devices. For example, a carrier and carrier stock which is the subject of copending U.S. Patent Application, Ser. No. 31231, filed Apr. 18, 1979, is particularly effective for use in combination with this invention.

The fixed jaw or stretching member, in cooperation with the reciprocating jaw or stretching member, with its reciprocating movement controlled by a cam follower and cam located laterally outside of its associated spider wheel, permits the area between each member of the pairs of jaws to be completely open, free and unattached, and thus greatly simplifies the operation of the machine.

The carrier stock stretching system of this invention which uniquely utilizes in each jaw station, a single, dynamic stretching member effectively cantilevered from its associated spider wheel by a relatively short length of control rod controlled by a single cam is substantially easier to maintain and use than any of the prior art devices or machines. The open space between the fixed jaw and moving jaw which comprise each jaw also facilitates the cleaning and/or repair and maintenance of the applicating system.

Other objects and advantages of the invention will become apparent upon a review of the following specification read in conjunction with the drawings.

BRIEF DESCRIPTION OF THE DRAWINGS

FIG. 4 is an enlarged side elevational view of one of the jaw stations of FIG. 1.

FIG. 5 is an enlarged top elevational view of the jaw station of FIG. 4.

FIG. 6 is an enlarged plan view of the work station as taken in the direction of line 6—6 of FIG. 1.

FIG. 7 is an enlarged side elevational view of the work station as taken in the direction of line 7—7 of FIG. 1.

DETAILED DESCRIPTION OF THE PREFERRED EMBODIMENT

Figure 1:
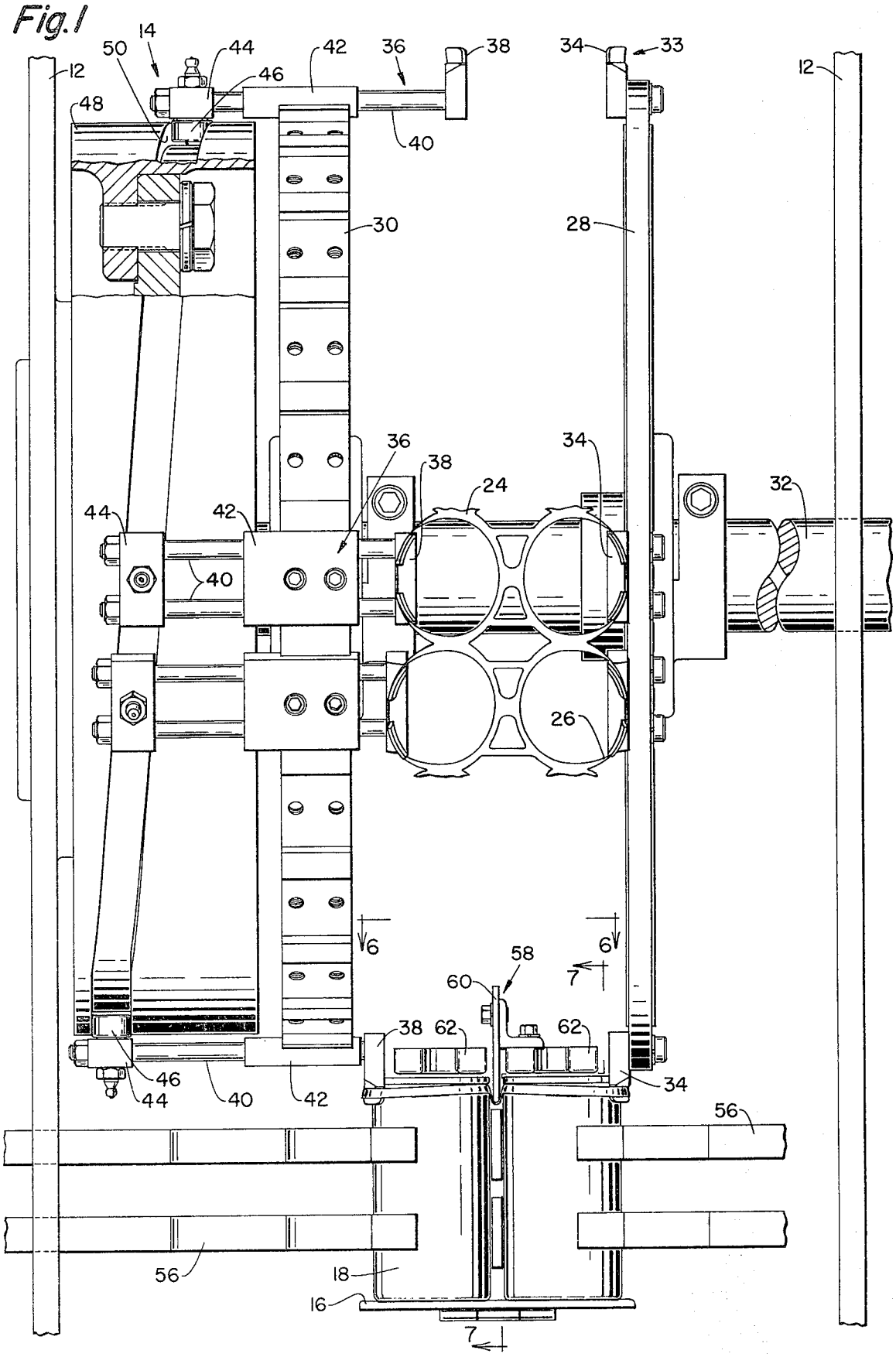
FIG. 1 is a fragmentary end elevational view of the wheel assembly of the subject invention.
Figure 2:
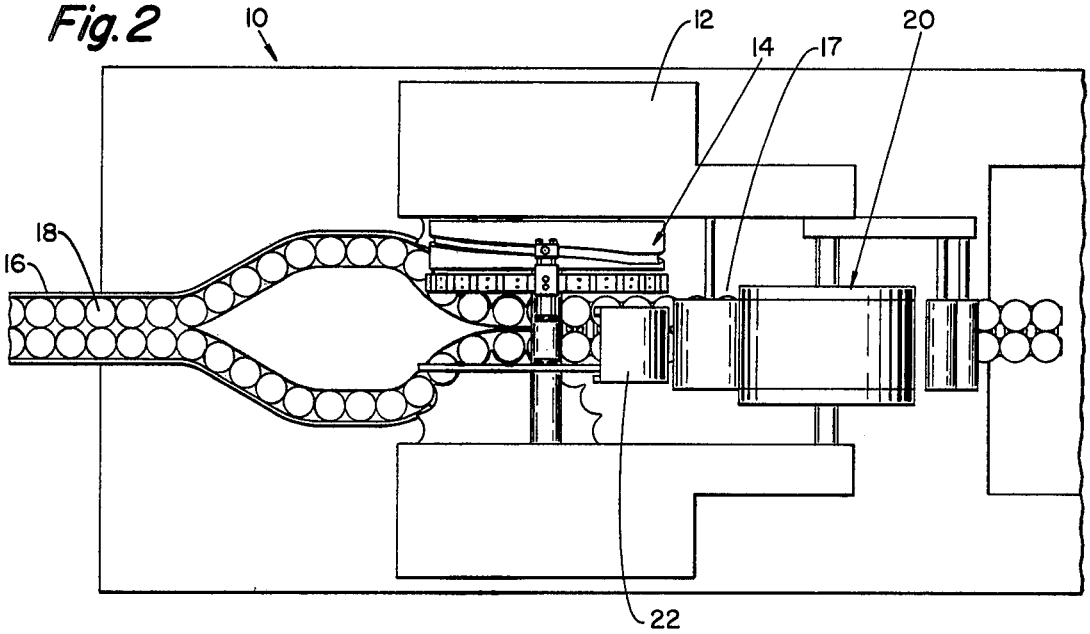
FIG. 2 is a top plan view of a machine incorporating the wheel assembly of the subject invention.
Figure 3:
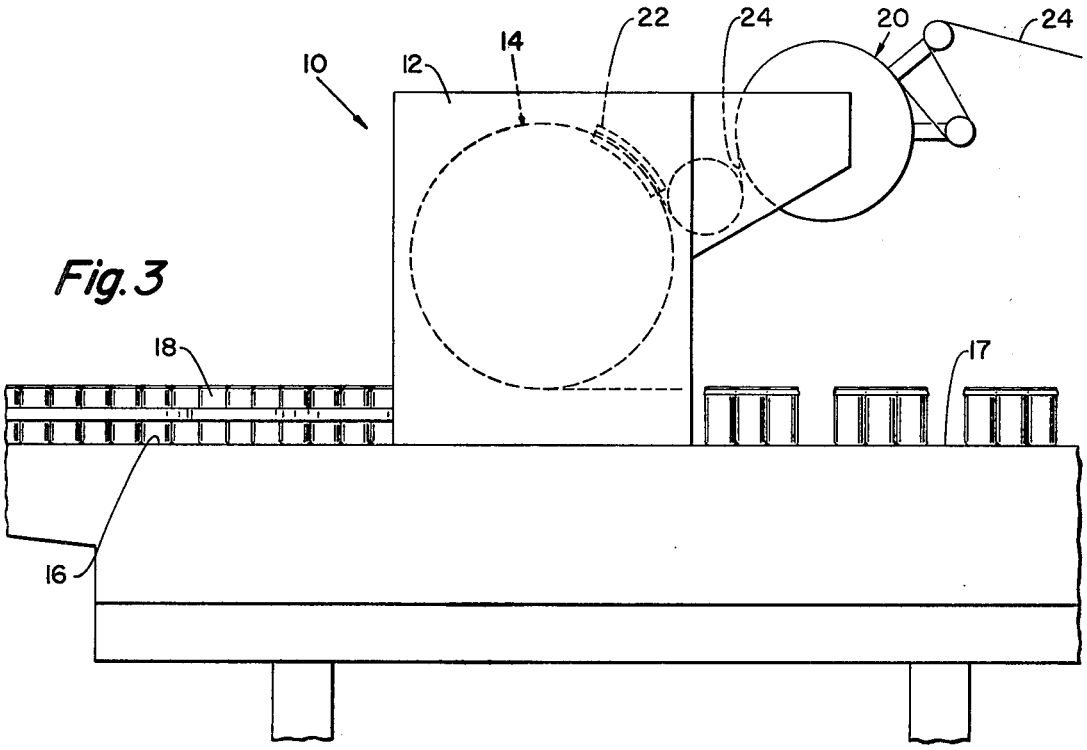
FIG. 3 is a side elevational view of the machine of FIG. 2.

The complete applicating machine 10 incorporating the invention, as shown in FIGS. 2 and 3, should be understood as being substantially exemplary in form since many of the elements in the total machine are not critical to the invention. Machine 10 comprises basically a wheel assembly 14 carried by a fixed supporting section 12, which in part forms a base for the machine, an input conveyer 16 for delivery of two or more rows of containers beneath the wheel assembly, output conveyer 17 for carrying the packages produced from the work station and suitable known means 20 for feeding the carrier stock 24 onto the wheel assembly. In conjunction with the carrier stock feed system 20, a guide assembly 22, shown in dotted lines in FIGS. 1 and 2, should be incorporated in the machine to properly locate the carrier stock on the wheel assembly. The guide system does not form a part of the invention and it should also be understood that a guide system as generally shown in U.S. Pat. No. 3,775,935 can be effectively utilized with this invention. It should also be understood that a suitable cut-off means, not shown, should be provided immediately adjacent the wheel assembly and the output conveyer to properly separate the multiples of containers into their desired package configuration.

The carrier stock 24 supplied to the machine is particularly designed so that opposed stretching forces applied by the jaw members within the side bands causes all of the transversely aligned bands to stretch into shapes which are complementary to the shapes of the containers.

With reference to FIG. 1, the wheel assembly 14 is shown with most of the jaw stations 33 removed to clearly show the details of the assembly. The assembly 14 comprises a pair of laterally spaced spider wheels 28 and 30 rotatively carried, between the support member 12, on a shaft 32 which rotates about a horizontal axis above the path of the conveyer. Appropriate means, not shown, may be provided for rotating the shaft and associated wheels 28 and 30 in timed relation to the movement of the containers 18 through the work station.

In contradistinction to the prior art drum assemblies, the spider wheels 28 and 30 are completely spaced from one another and yet, in combination carry a plurality of jaw stations 33 with each comprising a fixed jaw member 34 and a movable jaw assembly 36. The wheels rotate in planes which are perpendicular to the horizontal axis of rotation. It should particularly be noted that the plane of rotation of spider wheel 28 carrying the fixed jaw elements is located so as to be substantially coincident with the plane which includes one side margin of the rows of containers passing through the work station.

In contrast to the fixed jaw members 34, opposing spider wheel 30 carries reciprocating jaw assemblies 36. Bearing blocks 42 are fixed to the periphery of the spider wheel 30 so as to be laterally aligned with the fixed jaw members 34 on the opposing wheel 28. As shown more clearly in the details of jaw station 33 in FIGS. 4 and 5, the moving jaw assembly 36 includes, in addition to the bearing mounting block 42, jaw member 38 which is secured at one extremity to a pair of rods 40. The rods are journaled through bores in the bearing block 42 and are provided with a cam follower 46 and cam follower block 44 fixed at the opposite extremity thereof. Thus, the jaw member 38 is essentially cantilever supported laterally inwardly from the periphery of the spider wheel 30.

Turning again to FIG. 1, it will be shown that the lateral spacing of each moving jaw member 38 relative to its opposing fixed jaw member 34 is controlled by an annular cam element 48, which is secured to the fixed support 12. The cam 48, as in the prior art, may be formed from semicircular sections bolted together. A cam track 50 is formed about the periphery of the cam and receives each of the plurality of cam followers 46 associated with the moving jaw assembly 36. Cam track 50 is designed to create a cyclical reciprocating motion of the jaw 38, undulating towards and away from its associated fixed jaw member 34. The reciprocating jaw assembly 36 creates a dynamic stretching member while the fixed jaw 34 forms a reacting or static stretching member.

The cam groove 50 is also designed so that the jaw stations 33 are closed with the jaw member 38 being at its laterally inwardlymost position relative to its associated fixed jaw member 34 when the jaw station approaches the guide assembly 22, as depicted by the uppermost station of FIG. 1. A dwell region is preferred in the cam track as the moving jaw assemblies approach the guide region so that the carrier stock is properly seated and positioned on the jaw stations. Thereafter, the cam track is designed so that the moving jaw member 38 is gradually moved away from its fixed jaw member 34 approaching a maximum spaced relationship between the jaw members at the work station or slightly before the work station as depicted by the lowermost station of FIG. 1. Again, at this region, a dwell in the cam is preferred to permit the containers to be properly associated with the completely open apertures formed by the bands 26 in the container stock 24.

Since the carrier stock 24 is particularly designed to be reconfigured upon application of stretching forces applied solely at the outer band regions, it will be of a width that is less than the width of the lanes of containers to be encircled. It should be further noted that the carrier strip will not be centered relative to the rows of containers but will be positioned on the wheel assembly so that one lateral extremity of the strip, namely that associated with the fixed or static jaw members 34, lies in a plane which includes the margin of the rows of containers adjacent that spider wheel 28.

Since the region between the pair of jaw members making up each jaw station is completely open, in contrast to prior art drum devices, a carrier stripping and center tucking device is fixedly mounted at the work station beneath the wheel assembly. As shown in FIGS. 1, 6 and 7, this stripping assembly 58 basically comprises a centrally located blade 60 extending in a plane perpendicular to the plane of rotation of the wheel with a pair of cantilever shoe members 62 extending toward the flow of containers so as to be generally aligned over each of the rows of containers. With such an arrangement, the center web of the carrier stock is positively forced downwardly between the rows of containers by the arcutate front edge of the blade 60 to ensure that the innermost bands are locked beneath the chime of the container and the shoe members, in cooperation with the stripper blade, ensure that the carrier stock is properly stripped from the jaw stations as the rows of containers are metered to the work station by star wheels 56.

It should be apparent that the invention, while shown with two lanes of containers utilizing an appropriately designed two-lane carrier, could readily be adapted for use with three or more lanes of containers being fed through a work station with an appropriately designed carrier.

Likewise, the basic features of the invention could be utilized to simultaneously process or apply a carrier strip to another two or more lanes of containers fed through an appropriate conveyer system by producing a mirror image of the movable jaw assemblies 36 on the opposite side of the fixed spider wheel 28 and positioning a proper number of further fixed jaw members on the spider wheel 28 so that it may serve as the basis for the fixed jaw members for two jaw stations extended on either side of a single fixed jaw carrying spider wheel.

Having described the invention, it is to be understood that changes can be made in the defined embodiments by one skilled in the art within the spirit and scope of the present invention as defined in the hereinafter following claims.

I claim:

1. In an applicating machine for applying a carrier stock to containers in which the carrier stock is made of a resilient plastic material and comprises a longitudinally extending series of transversely arranged ranks of container encircling bands which are to be transversely stretched for application to successive ranks of a plurality of rows of containers passing through a work station in the machine, the improvement of a rotating wheel assembly for receiving said carrier stock and laterally stretching said carrier stock, said wheel assembly comprising a pair of spider wheels mounted in a parallel spaced apart relationship for rotation about a horizontal axis extending transversely to and above said series of containers, a series of pairs of opposed stretching members radially spaced about said horizontal axis carried on the periphery of each spider wheel and adapted to transversely stretch the carrier stock through application of forces only at the inner periphery of the outer band region of each rank of container encircling bands, a first member in each of said parts of stretching members being fixedly mounted to a first of said spider wheels and relative to the plane of rotation of said spider wheel, means for mounting the second member in each pair on a second of said spider wheels for reciprocating, linear, movement relative to its associated fixed first member in directions generally parallel to said horizontal axis.

2. The applicating machine of claim 1, wherein one of said pair of spider wheels include a plurality of first jaw members equally spaced about its periphery and fixedly secured thereto comprising the first members of each pair of stretching members, the second of said pair of spider wheels including a plurality of bearing members fixedly mounted and equally spaced about its periphery comprising part of the means for mounting the second members, the first jaw members and bearing members being aligned along axes parallel to the horizontal axis of the wheel assembly.

3. The applicating machine of claim 2, including cam means adjacent the second of said spider wheels, a plurality of second jaw members fixed to one extremity of rod means, cam follower means secured to the opposite extremity of said rod means, the rod means extending through and carried by the bearing mounting means, the cam, cam follower, rod and mounting means serving to reciprocate the second jaw members relative to the fixed first jaw members as the spider wheels are rotated about the horizontal axis.

4. The applicating machine of claim 1, wherein the pair of spider wheels and associated pairs of opposed stretching members are unconnected and unsupported in the regions of the peripheries of said wheels.

5. The applicating machine of claim 1, wherein the first members of said pairs of stretching members are mounted to rotate about the horizontal axis in a plane perpendicular to the horizontal axis while the second members of said pair of stretching members are mounted to rotate about the horizontal axis in an undulating pattern.

6. The applicating machine of claim 1, wherein a fixed stripper assembly is mounted at the work station comprising a pair of shoe elements located above the containers, a blade member mounted between the shoe elements and extending in a plane perpendicular to the horizontal axis of the wheel assembly, the blade member and shoe elements in combination insuring that the carrier stock is stripped from the stretching members onto the containers at said work station.

* * * * *